US005329655A

United States Patent [19]

Garner

[11] Patent Number: 5,329,655

[45] Date of Patent: Jul. 19, 1994

[54] SLIDABLE HOSPITAL SHEET FOR TURNING PATIENTS

[76] Inventor: Dean Garner, RFD 3, Box 335, Rupert, Id. 83350

[21] Appl. No.: 63,157

[22] Filed: May 18, 1993

[51] Int. Cl.[5] ..... A61G 7/10

[52] U.S. Cl. ..... 5/81.1; 5/502; 5/926

[58] Field of Search ..... 5/81.1, 486, 502, 926

[56] References Cited

U.S. PATENT DOCUMENTS

| | | | |
|---|---|---|---|
| 1,334,901 | 3/1920 | Higdon | 5/81.1 X |
| 3,829,914 | 8/1974 | Treat | 5/81 R |
| 3,849,813 | 11/1974 | Neilson | 5/81.1 |
| 4,051,565 | 10/1977 | Berge . | |
| 4,576,903 | 8/1985 | Parker | 5/81.1 |
| 4,944,053 | 7/1990 | Smith | 5/81.1 |
| 5,123,113 | 6/1992 | Smith | 2/2 |
| 5,148,558 | 9/1992 | Dunn | 5/81.1 |
| 5,155,874 | 10/1992 | Kershaw | 5/81.1 |

*Primary Examiner*—Michael F. Trettel
*Attorney, Agent, or Firm*—Thorpe, North & Western

[57] ABSTRACT

A sheet to be used to help turn or position a patient wherein the sheet includes a bottom surface and top surface, the bottom surface including opposing end portions and a central portion which has less frictional drag than the opposing end portions and top surface. The top surface is constructed in a configuration with an area larger than the area of the central portion at the bottom surface. A method of application is also disclosed.

2 Claims, 1 Drawing Sheet

SLIDABLE HOSPITAL SHEET FOR TURNING PATIENTS

BACKGROUND OF THE INVENTION

1. Field of the Invention

This invention relates to sheets, blankets and other forms of bed coverings which are used with patients. More particularly, the present invention pertains to such bed coverings used with patients requiring assistance in rolling over or turning.

2. Prior Art

Many illnesses tend to immobilize the patient, or at least make movement very difficult and/or painful. For example, patients who have back surgery are generally unable to move or rotate their body for several days, pending initial healing of the sutures. Any attempt by the patient to exert his own muscles to turn his body to a new position would not only be very painful, but could also tear sutures and cause severe damage. Nevertheless, laying in a single position for extended hours results in initial stages of necrosis of tissue due to poor blood supply. Accordingly, the patient feels compelled to rotate to a fresh position to relieve the discomfort.

Prior art techniques for assisting such a patient to turn have usually involved a medical attendant helping to lift the patient and thereby minimize the patient's muscular involvement. Even in the best of circumstances, such manipulations cause pain and often aggravate sensitive tissue. These consequences are further magnified where an attending family member without experience attempts to aid the patient.

In some instances, suspended bars or straps are provided above the patient to allow use of the arms to assist in patient rotation or turning. Hereagain, however, some muscular exertion occurs with its attendant pain and tissue damage. The only means currently provided to a patient to change positions in the bed arises with mechanical adjustments of inclination of the bed, thereby affecting upper and lower body inclination. Unfortunately, side-to-side movement is not facilitated by such repositioning, thereby severely limiting the ability of the patient to be comfortable.

Other prior art methods and devices have been developed for providing lateral displacement to a patient to thereby move the patient along the bed surface; however, this prior art has not offered any suggestion or technique for rotating the patient without muscular effort on the part of the patient. For example, U.S. Pat. No. 3,829,914 by Treat discloses an elongated, flexible laminated sheet which is approximately the same size in width as the patient. A frictional top surface and a slippery bottom surface are provided to enable an attendant to pull the sheet across the bed without patient movement. This device presumes that the patient will not rotate, because to do so would result in the patient being located off of the sheet, eliminating any further value of the sheet for this patient. The primary purpose of the device is to shift a patient who has slid down the bed to an original position, and not to rotate a patient from side to side.

U.S. Pat. No. 4,051,565 by Berge teaches the use of a tubular member which has an outer surface which develops frictional contact with a patient, and an inner tubular surface which has a low coefficient of friction. This device is also designed to provide lateral displacement of the patient, but without an intention of rotating the patient's body. Rather, the purpose of this tubular member is to allow a patient to remain in a single, flat position while moving sideways by having the tubular member roll along the bed surface. Accordingly, the frictionless surface traverses against itself with the outer frictional surface operating as a conveyor belt as shown in FIG. 4. There appears to be no provision or suggestion for turning the patient within his bed and without requiring lateral movement.

Other patent disclose the use of multiple layers of fabrics and materials to provide protection or mobility to the patient. U.S. Pat. No. 5,123,113 by Smith teaches the use of first, second and third fabrics (two of which are "frictionless") to isolate injured areas of the body such as elbows and knees from adverse frictional contact with bedding. These fabrics are formed in tubular configuration to enclose the arm or leg of the patient. The patent discloses the attachment of these tubular members to a sheet member which facilitates lateral movement of the patient without turning or rolling over.

A second patent by Smith using multiple layers of fabrics is U.S. Pat. No. 4,944,053. This patent teaches the use of first, second, third and fourth fabrics in stacked configuration as part of a narrow positioning pad which is disposed under the hips of the patient. The first fabric is generally draped across a table or bed and extends from side to side. The other fabrics are either coextensive with or longer than the first fabric. The four fabrics comprise two devices or pads which move with respect to each other and provide a sliding medium to allow the patient to roll or turn under their own power. The pair of devices are designed to allow the patient to turn in their "normal fashion".

Finally, U.S. Pat. No. 3,849,813 by Nielson shows a single sheet configuration designed to facilitate a patient turning himself on a top, substantially frictionless material. The bottom side is of conventional bedding material which has a higher frictional surface. The sheet is positioned on the bed with the bottom side down for maintaining the sheet in a non-sliding mode. The top, low friction surface directly supports the patient, allowing the patient to slide at will to turn or roll over.

Accordingly, the prior art has consistently been directed toward devices and methods which enable a patient to turn himself This has generally utilized multiple-layered pads or hardware associated with the bed frame. The present inventor has consciously avoided involvement of the patient for the sake of minimizing injury to sutures and associated pain. Indeed, what is needed is a method and device for enabling the turning of a patient while he is in a totally relaxed state. Rather than being a participant by tensing his muscles to turn himself, the patient should be turned while he is limp and passive.

OBJECTS AND SUMMARY OF THE INVENTION

It is therefore an object of the present invention to provide a device and method for turning a patient while in a relaxed and passive state to avoid pain and tissue damage.

It is a further object of the present invention to provide such a device and method which is simple, inexpensive and capable of application to the patient without the need of professional training.

It is a still further object of this invention to provide a device for turning a patient which does not require separate placement under the patient, but which is a natural part of the bedding such that it is always available for use without special preparation.

These and other objects are realized in a single sheet to be used to help turn or position a patient, wherein the sheet includes a bottom surface and top surface, the bottom surface having opposing end portions and a central portion. The central portion is fabricated of material having less frictional drag than the opposing end portions and the top surface, while the top surface is constructed in a configuration with an area larger than the area of the central portion of the bottom surface.

This device is implemented as part of a method for turning a patient on a bed with minimal pain and discomfort, wherein the method comprises the steps of a) selecting a single bed sheet having a bottom surface characterized by low frictional drag on one side and higher frictional drag on a top surface on an opposing side; b) placing the sheet on a bed surface with the bottom surface in contact with the bed surface and top surface exposed; and c) positioning a patient on the bed surface with most of the patient's torso on the top surface of the bed sheet.

Other objects and features of the present invention will be apparent to those skilled in the art, based upon the following detailed description, taken in combination with the accompanying drawings.

DETAILED DESCRIPTION OF THE INVENTION

Figure 1:
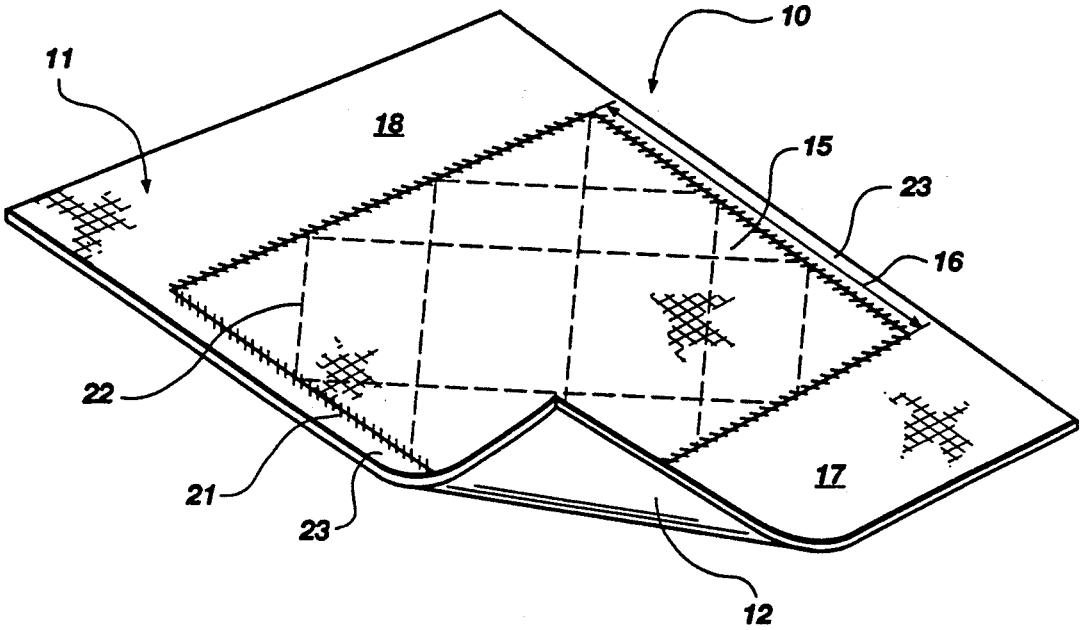
FIG. 1 shows an elevated, perspective view of a patient sheet embodying one example of the present invention.
Figure 2:
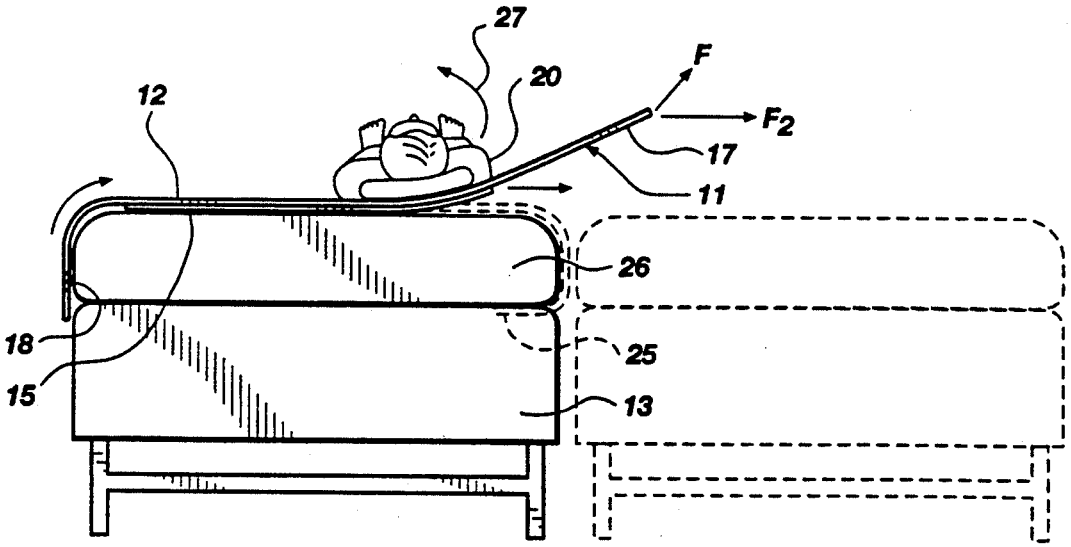
FIG. 2 graphically illustrates the use of the sheet of FIG. 1 as part of a method for turning a patient on a bed.

Referring to the drawings:

FIG. 1 depicts a patient sheet 10 which offers a substantially improved structure and method for turning and positioning a patient who is unable to move himself without otherwise incurring pain and/or resultant physiological injury. This sheet comprising a bottom surface 11 and top surface 12 which are defined in relation to the intended position upon a bed 13. It should be noted that the representation in FIG. 1 is inverted to illustrate the more important construction of this sheet at its bottom surface as compared to the top surface. Accordingly, the bottom surface 11 is actually exposed upward in the drawing and the top surface 12 is in a downward, partially concealed configuration. The proper orientation of the top and bottom surfaces of the sheet is shown in FIG. 2.

The sheet, including the top surface 12, is made of a material suitable for bed covering such as a cotton material or synthetic fabric such as polyester. This material offers substantial frictional drag when pulled against and along other similar bed clothing and materials. This drag is important because it supplies a resistance force which assists in turning the patient without patient exertion. The manipulation of the patient is explained hereafter.

In contrast to the conventional bedding material used for the top 12 of the sheet, a low frictional material is selected for a central portion 15 which is sewed, bonded or otherwise attached to the bottom surface of the sheet body. This central portion extends for approximately 42 inches in length 16 and covers at least 50% of the total sheet area of the bottom surface 11. Placement of the low frictional material in the middle of the sheet leaves opposing end portions 17 and 18 exposed with a higher frictional drag associated with the conventional sheet material similar to the top surface 12. These ends provide sufficient resistance to movement to retain the sheet in its place on the bed, particularly when the ends are tucked under the mattress as shown in FIG. 2. In this configuration, the friction between the ends of the sheet and the conventional bedding material resists slipping movement such as occurs with the central portion 15.

The central portion 15 is fabricated with a material that has less frictional drag than the opposing end portions and the top surface. The preferred embodiment for the central portion comprises a slick fabric such as 100% polyester, but could be made of other slick finishes such as satin, rayon, etc. Its location within a central portion of the sheet body provides slidable support for most of the weight of the patient.

The top surface 12 is constructed in a rectangular configuration with an area larger than the area of the central portion of the bottom surface. The preferred embodiment is dimensioned at 70 inches×45 inches, but could be manufactured in other sizes. Similarly, the low friction material of the bottom surface is rectangular in configuration with dimensions of approximately 42 inches×43 inches. Hereagain, other dimension could be selected, provided the length were sufficient to carry most of the weight of the patient's body 20.

The top 12 and bottom 11 surfaces may be sewn together 21 at the periphery of their junction, or may be bonded or quilted 22. A lateral portion 23 is formed on each side of the central portion and comprises the same material forming the sheet body. This configuration provides a continuation of the end portions and supplies greater frictional drag than the central portion to facilitate greater frictional grip when tucked 25 under a mattress 26 as is shown in phantom line.

The present invention addresses the problem of turning the patient by adopting the philosophy that less risk of injury to the patient, as well as less pain, will follow where the patient remains totally relaxed. This is particularly true after surgery where incisions have been made through muscle tissue. In such cases, any muscular tensing can tear tissue around sutures and cause extreme pain. The method of turning the patient with the sheet described involves having the patient assume a totally relaxed posture as shown in FIG. 2. The patient simply retains this attitude while an attending individual manipulates the sheet to roll the patient to one side or the other.

The actual method of manipulation involves grasping one end (17 in FIG. 2) and gradually applying a force F in a lateral, upward direction. The low frictional surface 15 of the bottom side of the sheet facilitates the lateral movement by offering minimal resistance against the pulling action of the attendant. By gently lifting up on the end 17, the patient is slightly tilted back toward the center of the bed, commencing the turning or rolling action. The rate of turning can be easily controlled by the degree of lift applied to the sheet. Using this technique, the patient can be rotated 27 to his side, or all the way onto his front. By applying the same method from the opposing end 18, the patient can be rotated in the opposing direction. No patient exertion is required with respect to movement in either direction.

This method is generally represented by the following steps of:

a) selecting a bed sheet having a bottom surface characterized by low frictional drag on one side and higher frictional drag on a top surface on an opposing side;

b) placing the sheet on a bed surface with the bottom surface in contact with the bed surface, with the top surface being exposed; and c) positioning a patient on the bed surface with most of the patient's torso on the top surface of the bed sheet.

By securing at least one end of the sheet underneath the mattress with the surface characterized by higher frictional drag, the sheet position on the bed can be stabilized when not lifting or turning the patient, thereby preventing inadvertent slipping of the sheet from its secured position. The patient can also be moved from one bed to another bed by application of the same techniques by grasping on the end 17 with a force $F_2$, in reference to the relevant phantom line depiction of a second bed surface in FIG. 2. Specifically, a medical attendant may transfer the patient in accordance with the steps of;

a) untucking side portions of the sheet from under the bed, thereby allowing the sheet to hang freely on the bed;

b) pulling laterally on one side of the sheet and causing the bottom surface of the sheet to slide along the bed surface to a second bed surface, thereby moving the patient who is laying on the sheet.

It will be apparent to those skilled in the art that the foregoing examples and procedures are given to illustrate the basic invention and not to be limiting with respect to the following claims.

I claim:

1. A method for turning a patient on a bed with minimal pain and discomfort, said method comprising:

a) selecting a bed sheet having a bottom surface characterized by low frictional drag on one side and higher frictional drag on a top surface on an opposing side;

b) placing the sheet on a bed surface with the bottom surface in contact with the bed surface, said top surface being exposed;

c) positioning a patient on the bed surface with most of the patient's torso on the top surface of the bed sheet; and d) securing at least one end of the sheet underneath the mattress, said at least one end including a surface characterized by higher frictional drag which is in contact with a similar frictional surface of the mattress or a mattress cover to thereby prevent inadvertent slipping of the sheet from its secured position.

2. A method for turning a patient on a bed with minimal pain and discomfort, wherein the patient is moved from one bed to another bed by a medical attendant, said method comprising:

a) selecting a bed sheet having a bottom surface characterized by low frictional drag on one side and higher frictional drag on a top surface on an opposing side;

b) placing the sheet on a bed surface with the bottom surface in contact with the bed surface, said top surface being exposed;

c) positioning a patient on the bed surface with most of the patient's torso on the top surface of the bed sheet;

d) untucking side portions of the sheet from under the bed, thereby allowing the sheet to hang freely on the bed; and e) pulling laterally on one side of the sheet and causing the bottom surface of the sheet to slide along the bed surface to a second bed surface, thereby moving the patient who is laying on the sheet.

* * * * *